United States Patent [19]

Ishihara

[11] 4,254,581

[45] Mar. 10, 1981

[54] LOUVER SHUTTER WITH MOVABLE LOUVER BOARDS

[76] Inventor: Norisue Ishihara, 1941 Jindaiji-cho, Chofu-shi, Tokyo, Japan

[21] Appl. No.: 918,162

[22] Filed: Jun. 22, 1978

[30] Foreign Application Priority Data

Jun. 22, 1977 [JP] Japan ..... 52/74593
Feb. 28, 1978 [JP] Japan ..... 53/21547

[51] Int. Cl.[3] ..... E06B 7/086; E06B 7/09
[52] U.S. Cl. ..... 49/82; 49/75
[58] Field of Search ..... 49/75, 62, 64, 82, 86, 49/87, 88, 90

[56] References Cited

U.S. PATENT DOCUMENTS

| | | | |
|---|---|---|---|
| 1,014,679 | 1/1912 | von Wagner | 49/86 X |
| 2,227,360 | 12/1940 | Nelson | 49/87 X |
| 2,579,905 | 12/1951 | Coby | 49/82 |
| 2,761,673 | 9/1956 | Cline | 49/87 |
| 3,068,971 | 12/1962 | Ringler | 49/82 X |
| 3,991,518 | 11/1976 | Ishihara | 49/75 |

FOREIGN PATENT DOCUMENTS

| | | | |
|---|---|---|---|
| 649156 | 6/1964 | Belgium | 49/82 |
| 683799 | 12/1952 | United Kingdom | 49/82 |

*Primary Examiner*—Philip C. Kannan
*Attorney, Agent, or Firm*—Jones, Thomas & Askew

[57] ABSTRACT

This invention relates to a louver shutter with movable louver boards in which a set of adjustable louver boards capable of opening and closing are aligned in one side, the upper part, or lower part of the panel of a louver shutter or door, thereby to permit good ventilation, lighting and shielding of the room, to serve security purpose, and to prevent entry of rain water and harmful insects into the room. This invention provides a very practical and inexpensive louver shutter of simple mechanism which is sturdy in construction, easy to operate, and can be mass-produced, without any disadvantages encountered in conventional ones as disclosed in U.S. Pat. No. 3,991,518.

4 Claims, 14 Drawing Figures

LOUVER SHUTTER WITH MOVABLE LOUVER BOARDS

DESCRIPTION OF PRIOR ART

As is well known, the conventional louver shutters, in which the louver boards are rigidly secured in the door frame, have such disadvantages that adjustment of ventilation and lighting, or coutrol against entry of rain and wind in response to seasonal or climatic variations is impossible, and that the use of an exterior sliding door or an interior curtain is required to achieve complete shielding. Although another type of louver blinds are also known which allows adjustment of ventilation and lighting as well as complete shielding, they are of suspension type to be used inside the room, which are of no use for lock-out purpose and tend to swing freely and lose their adjusting function under windy conditions.

Most of the doors presently used have a glass plate set in its upper portion, or are panels made of wood board, steel plate or glass plate. Doors with louver boards secured in the upper or lower part thereof are also known. In the former type of doors shielding and ventilation is impossible although good lighting is obtained. On the contrary, the problems of insufficient ventilation, lighting and shielding are encountered in the latter type of doors. Thus, any of the doors stated above suffers from the disadvantage that desirable response to environmental variations for good living conditions is not expected, and also suffers from the security problem because they must be opened for outdoor communication, such as for identification of or conversation with visitors.

Further, there are known rotary transom windows comprising a glass plate set into a frame whose both sides are pivotally mounted at its upper, middle or lower part. Because of the large width, however, such transom windows tend to open to a wider degree with a given rotation, making fine adjustment for smooth ventilation difficult. Moreover, rain water and harmful insects are liable to enter the room, and the problem of insufficient security also exists.

This invention relates to a louver shutter with movable louver boards which can provide adjustable ventilation and lighting as well as complete shielding by simple operation and prevent entry of rain water and harmful insects.

DESCRIPTION OF DRAWINGS

This invention is illustrated in the drawings wherein.

DESCRIPTION OF THE EMBODIMENTS

Figure 1:
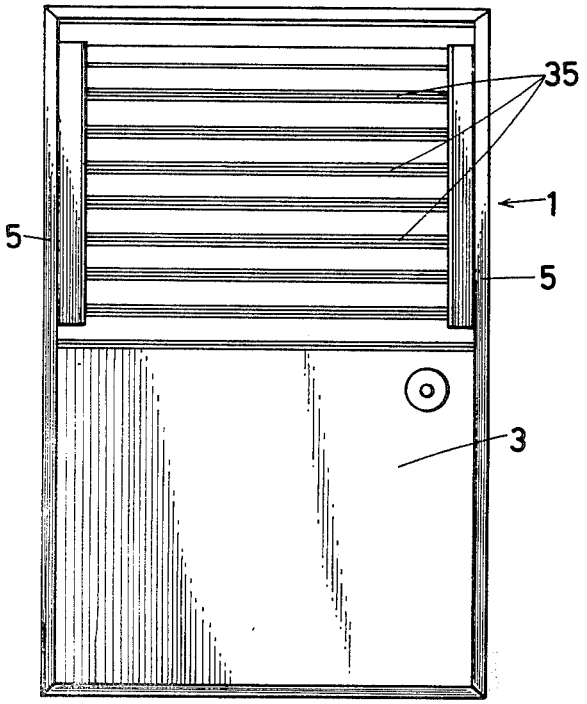
FIG. 1 is a front view of the door with movable louver boards in this invention.
Figure 2:
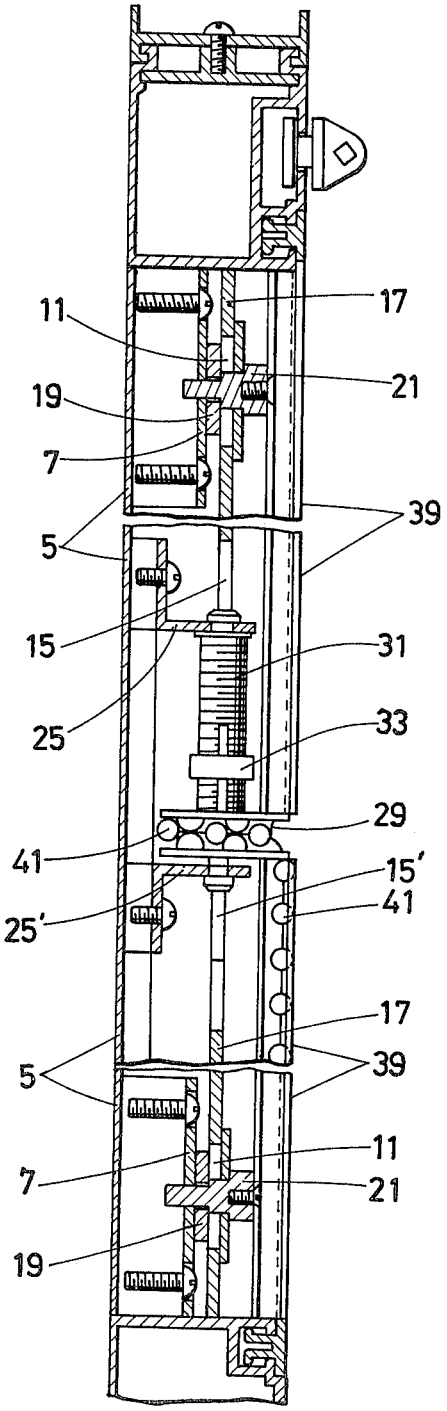
FIG. 2 is an enlarged, longitudial cross-sectional view of the principal portion of the door.
Figure 3:
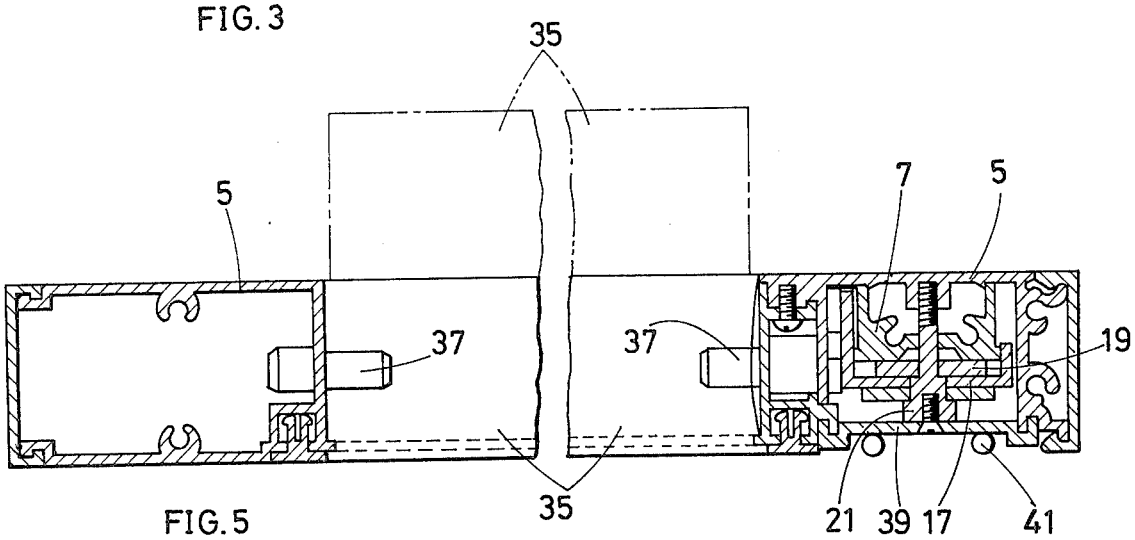
FIG. 3 is an enlarged, lateral cross-sectional view of the principal portion of the door.

FIGS. 1 to 4 show the first embodiment of this invention, in which a set of movable louver boards are provided in the upper half of a door. Door 1 comprises lower plate 3, two vertical frames 5 mounted above said lower plate 3, guide frames 7 provided along the inside of one of said vertical frames 5, and a sliding frame 17 having U-shaped cross-section, a set of engaging recesses 9 aligned on one side thereof, longitudially elongated holes 11 on the upper and lower part thereof, a laterally elongated hole 13 cut-out in the middle and having play holes 15,15' extending upward and downward therefrom. The sliding frame 17 is secured to the outer surface of the guide frame 7 by means of screws 21 through intermediaries 19 and holes 11. The engaging hole 13 of sliding frame 17 is engaged with female piece 33 threaded with drive screw 31 having gear 29 near the lower end of said drive screw being supported by L-shaped bearing 25', the upper end of said drive screw being supported by L-shaped bearing 25. Each recess 9 of sliding frame is engaged with crank shaft 37 inserted into the base of individual louver board. A cover 39 is provided on the outer side of sliding frame, and the gearing 29 is entrained with chain 41.

In a door as above composed, each louver board 35 can be opened by rotating the gear counterclockwise or by pulling down the left-side portion of the chain. In this way the drive screw 31 is rotated to drive the female piece 33 upward, which in turn raises the sliding frame 17 engaged therewith through engaging hole 13; and crank shaft 37 engaged with engaging hole 9 of sliding frame will then rotate, opening all the louver boards 35 upward. For closing louver boards 35, the right-side portion of the chain 41 is pulled downward to rotate the gear 29 in the reverse direction. The female piece 33 will descend with simultaneous descending of sliding frame 17, and the downward movement of the engaging recess 9 causes reverse rotation of crank shaft 37 to close all the louver boards downward. The degree of opening and closing the louver boards can be controlled only by the controlled pull of the chain 41 and can be maintained at any desired level.

Figure 5:
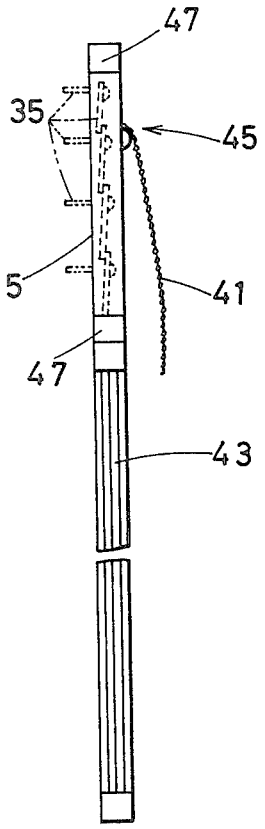
FIG. 5 is a side view of the door in the second embodiment of this invention.
Figure 6:
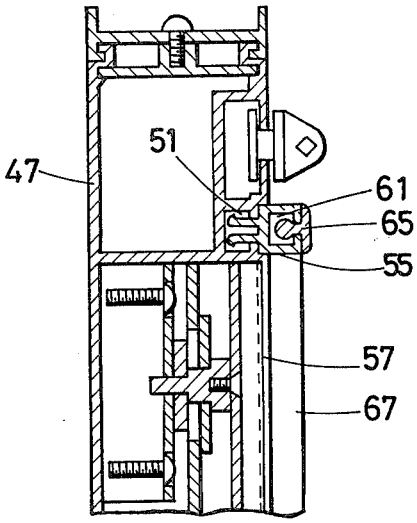
FIG. 6 is an enlarged, longitudial cross-sectional view of the principal portion of the above-mentioned door.
Figure 7:
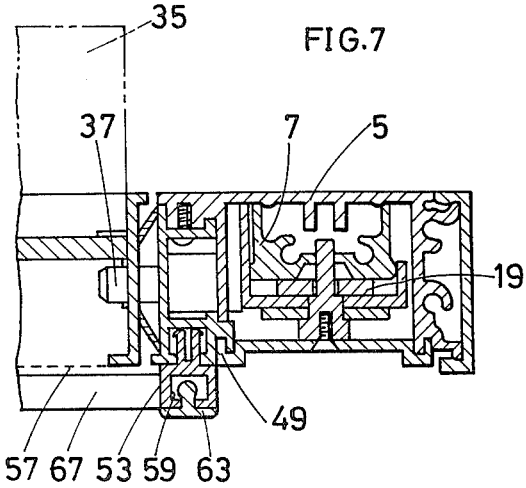
FIG. 7 is an enlarged, lateral cross-sectional view of the above-mentioned principal portion.
Figure 4:
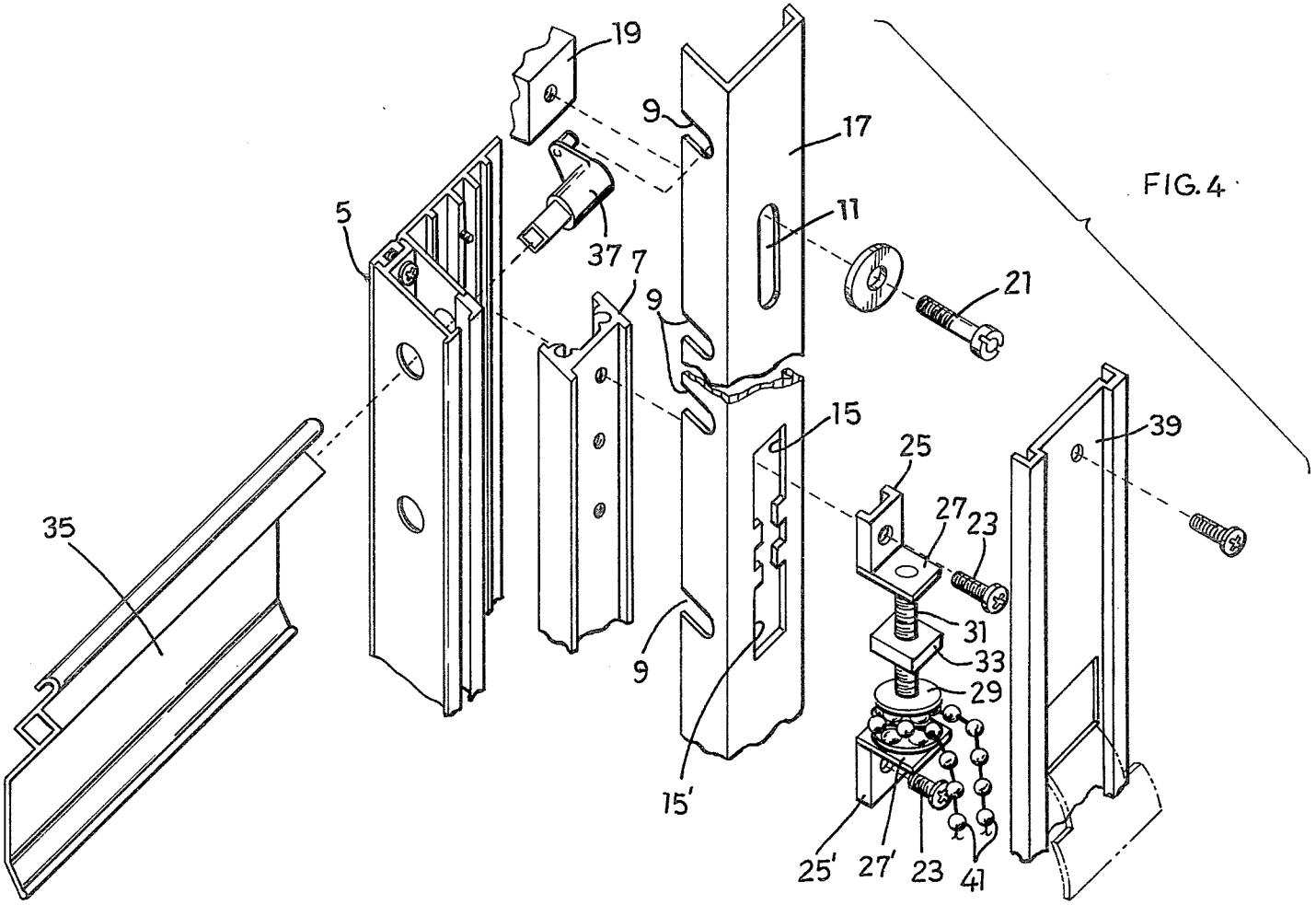
FIG. 4 is an oblique projection of disassembled parts of the principal portion of the door.

FIGS. 5 to 7 show the second embodiment of this invention, in which movable louver boards are set in a transom window mounted above an aluminum window sash. Movable louver boards as described in the first embodiment are set in a transom window frame 45 mounted above an aluminum sash 43, in which dovetail slots 49, 51 are formed along the inside of all vertical (5,5) and lateral (47,47) frames of said transom window 45. The dovetail slots 49, 51 and retainers 53, 55 designed to fit the same are used to tightly retain the periphery of an insect screen 51; in a second application, a transparent film 67 can be tightly retained on its periphery by means of said dovetail slots, other dovetail slots 59, 61 integrally formed at the top of said retainers 53, 55, and other retainers 63, 65 formed in a manner to fit said dovetail slots 59, 61. Such louver boards 35 as stated above can be opened or closed to any desired opening degree only by controlled pulling of the chain, and prevent entry of harmful insects, dirt, rain water, etc. because of the presence of the insect screen tightly set on is backside.

Figure 8:
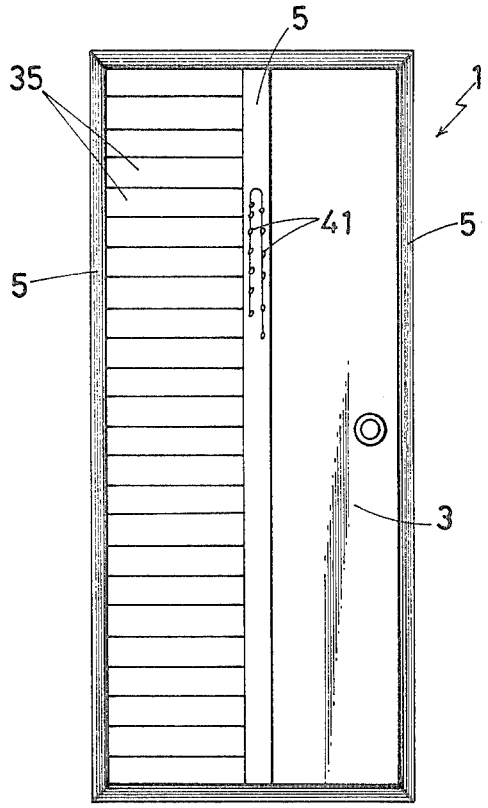
FIG. 8 is a front view of the door in the third embodiment of this invention.

FIG. 8 is a front view of the third embodiment of this invention, in which movable louver boards 35 are provided in one side of a door panel.

Figure 9:
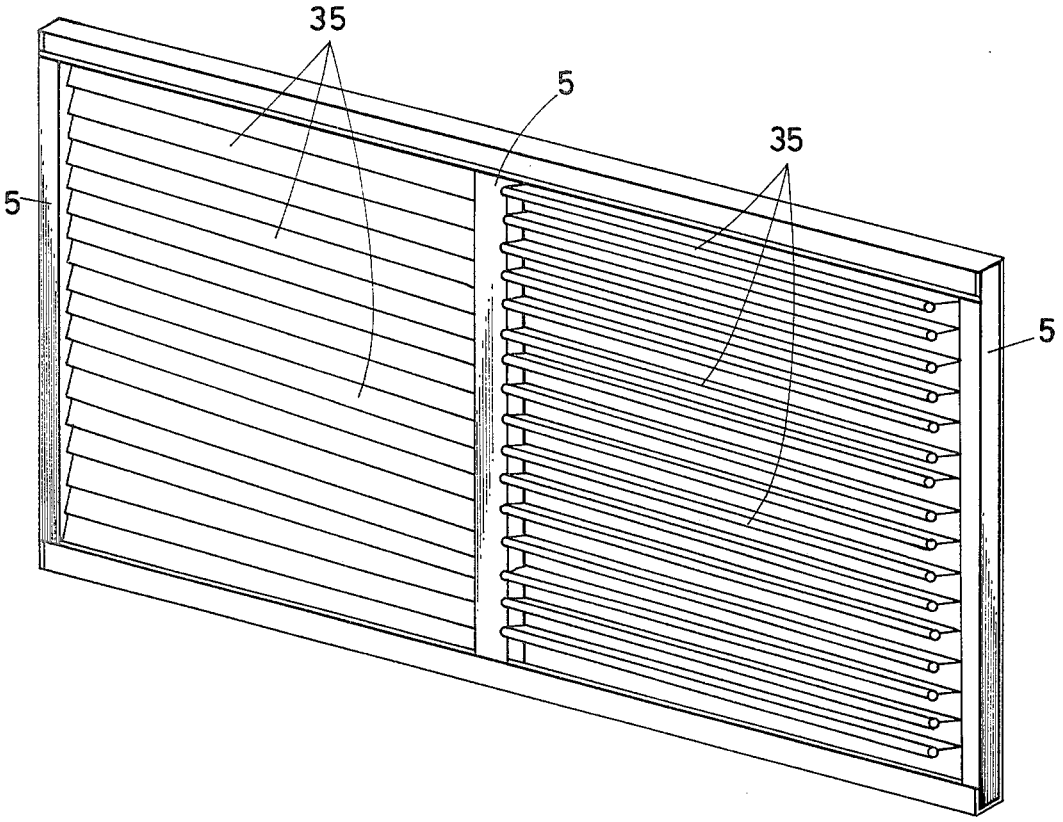
FIG. 9 is an oblique projection of the door in the fourth embodiment of this invention.
Figure 10:
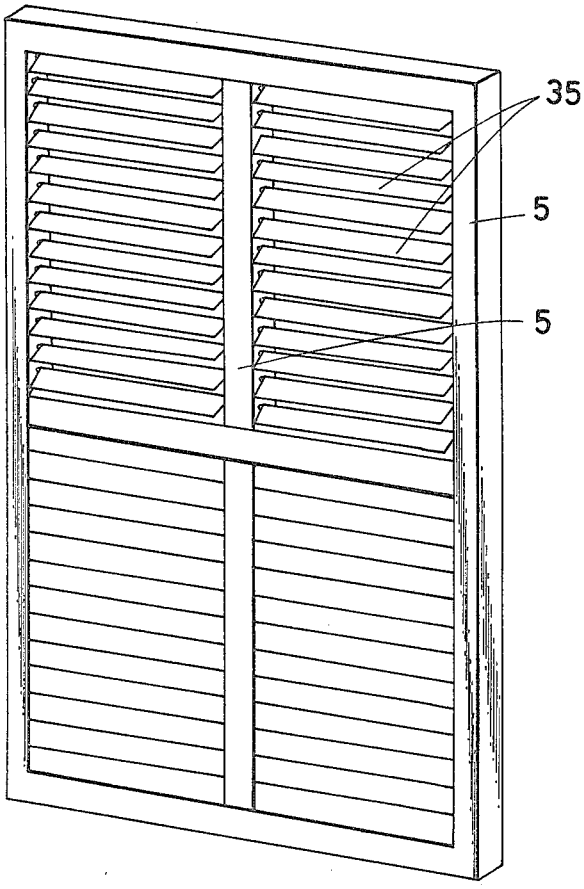
FIG. 10 is an oblique projection of the door in the fifth embodiment of this invention.
Figure 11:
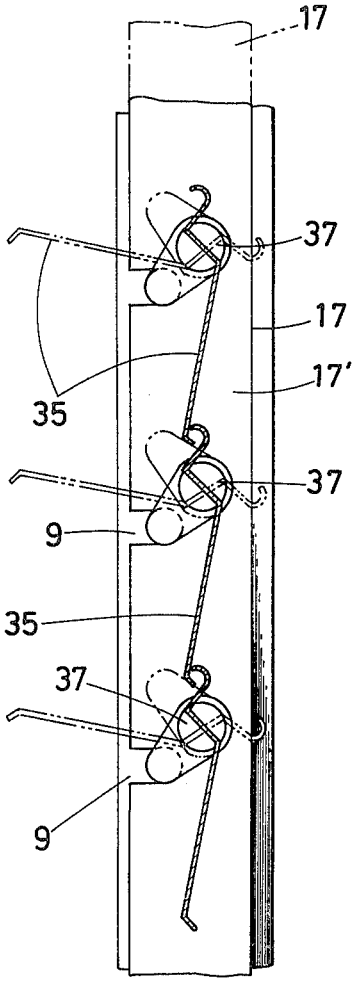
FIG. 11 is an enlarged, longitudial cross-sectional view of the principal portion of the above-mentioned door.
Figure 12:
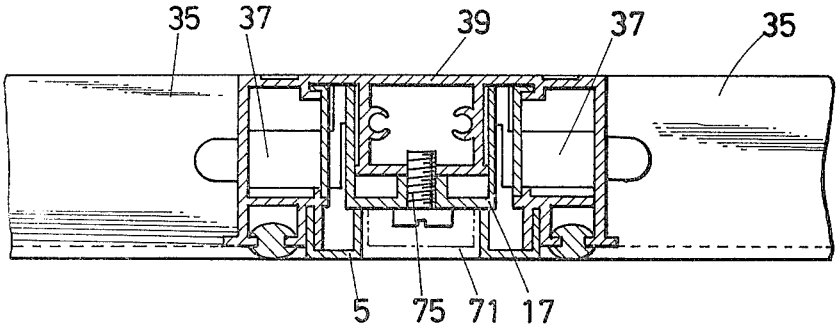
FIG. 12 is an enlarged, lateral cross-sectional view of the above-mentioned principal portion.
Figure 13:
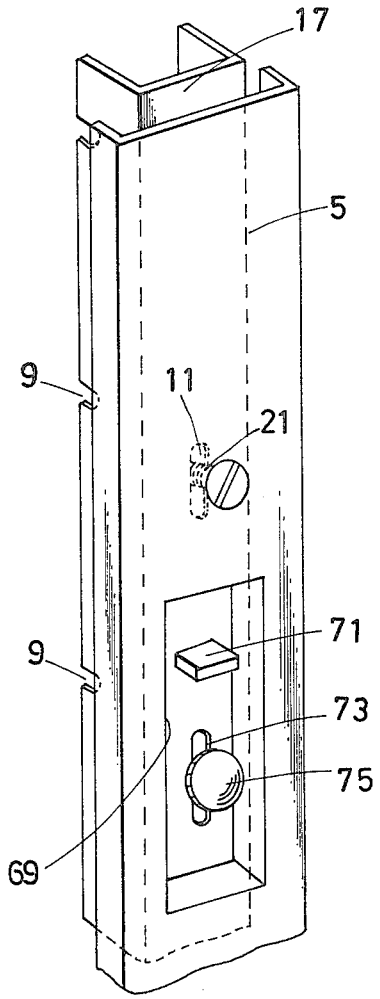
FIG. 13 is an enlarged, oblique projection of part of the vertical frame accommodating the sliding frame in the above-mentioned principal portion.
Figure 14:
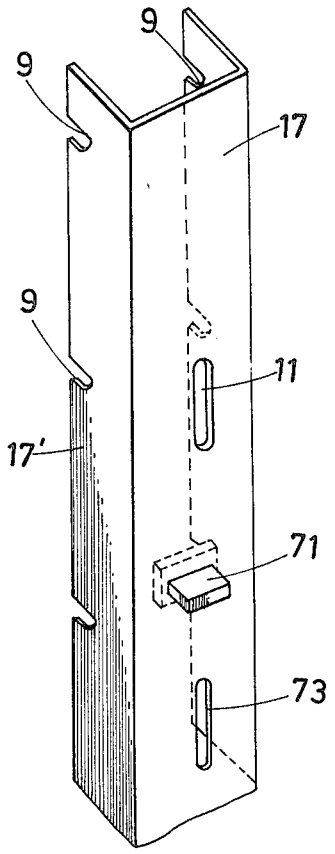
FIG. 14 is an enlarged, oblique projection of part of the above-mentioned sliding frame.

FIG. 9 is an oblique projection of the fourth embodiment of this invention, in which movable louver boards are provided in a louver shutter.

FIGS. 10 to 14 show the fifth embodiment of this invention, in which both ends of each louver board base 35 (not shown in the drawings) and crank shafts are pivotally mounted on the vertical frames 5,5 of the louver shutter. Crank shafts 37 mounted on one frame are engaged with that vertical frame 5 and with the engaging recesses 9 of the sliding frame mounted inside that vertical frame. The outer frame 39 is placed on the outer side of the vertical frame 5 and is integrally secured thereto through the longitudially elongated hole 11 by means of screw 21. A knob 71 is provided on the front surface of the sliding frame 17 exposed through the window hole 69 of the vertical frame 5. The sliding frame has also an elongated guide hole 73, through which the screw 75 for fastening louver boards 35 to the vertical frame is screwed through the sliding frame 17.

In the louver shutter described above, opening and closing of the louver boards 35 can be effected by upward and downward movement of the knob 71 which causes the crank shaft 37 to rotate. When a desired opening degree of the louver boards in obtained, the screw 75 is fastened thus permitting the desired condition to be maintained.

As explained above, the louver shutter with movable louver boards of this invention permits ready adjustment of ventilation and lighting as well as complete shielding by simple operation and prevents entry of rain water and harmful insects, thus providing a highly practical importance.

The embodiments illustrated in the drawings and explained above are only part of preferred ones and many different embodiments can be made without departing from the spirit and scope of this invention.

What is claimed is:

1. A louver shutter comprising, a plurality of louver boards, each of said louver boards having a shaft at one end and a crank shaft at the other end;

a first frame receiving each of said crank shafts;

a second frame mounted so as to be slidably movable with respect to said first frame and operatively engaging said crank shafts so as to open or close said louver boards in response to selected sliding movement of said second frame in either a first direction or a second direction;

an engaging hole formed in said second frame;

a rotatable drive member operatively associated with said second frame; and means disposed within said engaging hole to engage said second frame, and mounted on said rotatable drive member so as to be selectably moved in said first or second directions in response to rotation of said drive member, so that the movement of said means imparts sliding movement of said second frame and thereby opens or closes said louver boards.

2. Apparatus as in claim 1, wherein: p1 said rotatable drive member comprises a drive screw; and said means comprises a threaded member rotatably mounted on said drive screw and engaged within said engaging hole of said second frame, so that rotation of said drive screw causes said threaded member to slidably move said second frame member and thereby to open or close said louver boards.

3. Apparatus as in either of claims 1 or 2, further comprising:

gear means rotatably engaging said rotatable drive means, and a chain entrained with said gear means and extending for access of an operator, so that movement of said chain in either direction rotates said rotatable drive means and thereby either opens or closes said louver boards.

4. Apparatus as in claim 3, wherein said first frame and said second frame are vertical frames, and said louver boards are horizontal.

* * * * *